United States Patent [19]

Mazzeo et al.

[11] 4,099,826

[45] Jul. 11, 1978

[54] FEED-THROUGH TERMINAL BLOCK

[75] Inventors: Charles F. Mazzeo, Scotch Plains; William T. Waddington, Fanwood, both of N.J.

[73] Assignee: Amerace Corporation, New York, N.Y.

[21] Appl. No.: 785,531

[22] Filed: Apr. 7, 1977

[51] Int. Cl.[2] ..... H01R 9/10

[52] U.S. Cl. ..... 339/198 R; 339/263 R

[58] Field of Search ..... 339/31 R, 31 B, 31 L, 339/31 M, 32 R, 32 M, 33, 198 R, 198 K, 198 G, 198 GA, 192 R, 195 R, 195 A, 17 L, 17 LM, 17 LC, 17 C, 263 R

[56] References Cited

U.S. PATENT DOCUMENTS

| | | | |
|---|---|---|---|
| 2,938,187 | 5/1960 | Brodrick et al. | 339/31 M |
| 3,904,266 | 9/1975 | Fitzpatrick | 339/198 R |

FOREIGN PATENT DOCUMENTS

| | | | |
|---|---|---|---|
| 2,448,208 | 4/1975 | Fed. Rep. of Germany | 339/17 C |
| 1,068,359 | 5/1967 | United Kingdom | 339/198 R |

*Primary Examiner*—Neil Abrams

*Attorney, Agent, or Firm*—S. Michael Bender

[57] ABSTRACT

A dual orientation feed-through terminal block capable of being mounted selectively in either one of two orientations and including an electrical terminal member affixed in the block and having a contact extending through a slot in the block, the contact being permanently deformable into remains affixed in the block, to provide a feed-through in a direction appropriate to the selected mounting orientation.

8 Claims, 8 Drawing Figures

FEED-THROUGH TERMINAL BLOCK

The present invention relates to electrical connectors and pertains, more specifically, to terminal blocks of the type which provide a barrier strip interface between external conductors and further circuitry.

The manufacture of electrical and electronic equipment in ever-increasing numbers has led to the development of a wide variety of electrical connectors which enable the connection of external conductors to the circuitry within such equipment. Feed-through terminal blocks or strips have been utilized for the selective connection and disconnection of the external conductors to the internal circuitry of the equipment. The impetus toward compact design in such equipment coupled with the necessity of preserving ease of access to the external terminals provided by the feed-through terminal blocks requires that the terminal blocks be mounted in various orientations, relative to the supporting structure. Hence, the terminal blocks have been supplied in different configurations for different mounting orientations so that it becomes necessary to choose the appropriate terminal block for any particular installation.

It is an object of the present invention to provide a single feed-through terminal block construction which can be adapted readily for mounting upon a support structure in more than one orientation relative to the support structure to preserve easy access to the terminals of the terminal block while providing the appropriate feed-through to further circuitry within the structure.

Another object of the invention is to provide a feed-through terminal block in which the terminals each include a feed-through contact which is capable of permanent deformation, while the terminal remains secured in the block, to a position appropriate to the desired orientation of the mounted terminal block.

Still another object of the invention is to provide a feed-through terminal block capable of being mounted in either one of two mounting positions and having terminals with permanently deformable electrical contacts which can be bent to the appropriate direction for proper feed-through when the terminal block is mounted in a chosen position, the bending taking place after complete assembly of the electrical contacts with the terminal block, and before the terminal block is mounted in the chosen mounting position.

A further object of the invention is to provide a terminal block of the type described and which establishes an appropriate interface between external conductors and further circuitry while providing an effective barrier against short circuits.

A still further object of the invention is to provide a terminal block of the type described and having a simplified construction including a unitary block of dielectric material with unitary terminals anchored therein for ease of manufacture in large quantities of uniform high quality.

The above objects, as well as still further objects and advantages, are attained by the present invention which may be described briefly as a dual orientation feed-through terminal block for detachably connecting external electrically conductive elements to further circuitry, the terminal block comprising a block of dielectric material having opposite sides, a first base extending between the sides, and a second base extending between the sides and making an angle with the first base, at least one recess in the block, a slot in the block, the slot having a continuous opening facing both of the first and second bases and communicating with the recess, and an electrical terminal member affixed to the block within the recess, the terminal member having a terminal portion for selectively connecting and disconnecting an external conductive element and the terminal member, and an integral electrical contact extending through the slot and projecting beyond one of the bases, the contact being permanently deformable into one of first and second positions, while the terminal member remains affixed to the block, the contact in the first position thereof projecting beyond the first base and the contact in the second position thereof projecting beyond the second base, whereby the block may be mounted upon either selected one of the first and second bases and provide a feed-through beyond the selected one of the bases.

The invention will be more fully understood, while still further objects and advantages will be made apparent, in the following detailed description of preferred embodiments of the invention illustrated in the accompanying drawing, in which.

Figure 1:
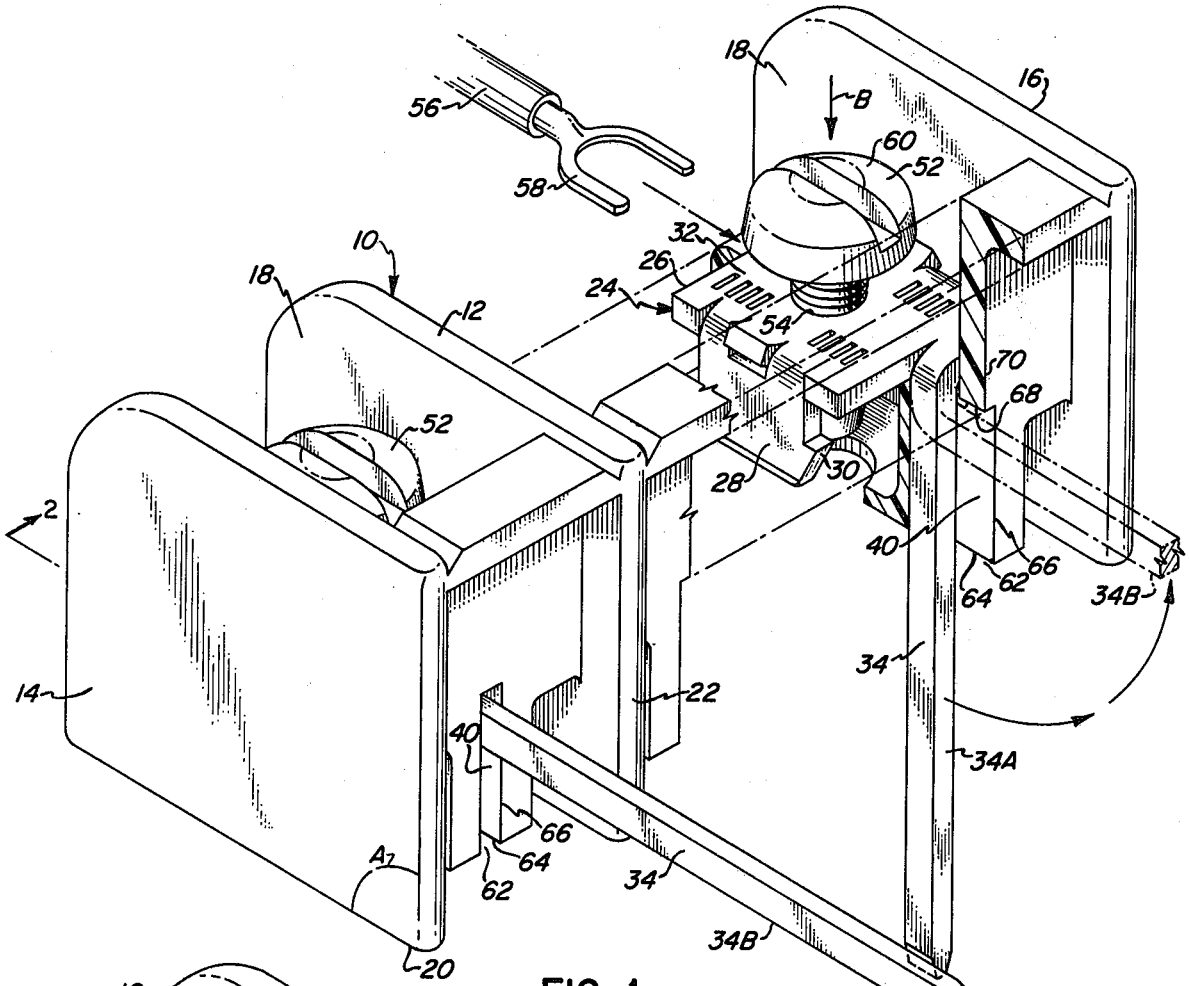
FIG. 1 is a perspective view of a terminal block constructed in accordance with the invention, the block being partially cut away to reveal internal details.
Figure 2:
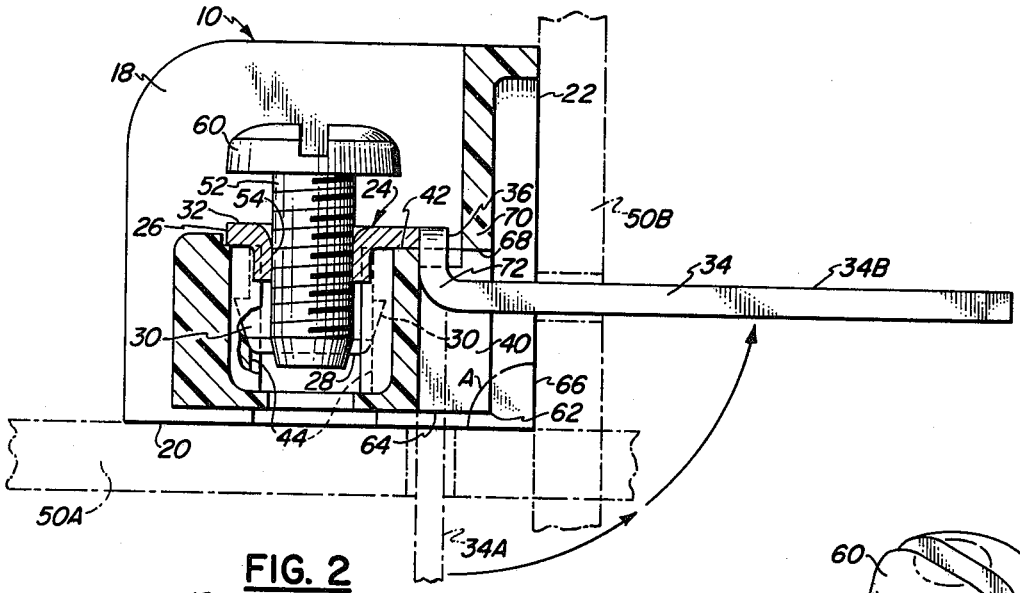
FIG. 2 is a cross-sectional view taken along line 2—2 of FIG. 1.

Referring now to the drawing, and especially to FIGS. 1 and 2 thereof, a feed-through terminal block constructed in accordance with the invention is illustrated at 10 and is seen to include a block 12 of dielectric material. Block 12 has opposites sides 14 and 16 and a plurality of recesses 18 spaced along the block between the sides 14 and 16. A first base 20 extends along the block 12 between sides 14 and 16. A second base 22 also extends along the block 12 between sides 14 and 16 and makes an angle A with the first base 20. In this instance angle A is 90° so that the terminal block 10 can be mounted in either one of two orientations which are perpendicular to one another, by mounting the block 12 upon either base 20 or base 22.

An electrical terminal member 24 is affixed to block 12 within each recess 18. Each terminal member 24 has a terminal portion which includes a platform 26 and depending legs 28 which carry teeth 30. Platform 26 has an upper surface 32 and an electrical contact element 34 which is integral with platform 26 at the forward edge 36 (see FIG. 2) thereof and which normally extends downwardly relative to the upper surface 32, as seen in full lines at 34A in FIG. 1, and in phantom at 34A in FIG. 2.

Terminal member 24 is assembled with block 12, when contact element 34 is in the downwardly extending position, by inserting terminal member 24 into recess 18 in a downward direction, as indicated by the arrow B in FIG. 1. Contact element 34 passes through a slot 40 which communicates with recess 18 and enables the terminal member 24 to be moved downwardly until the platform 26 becomes seated upon a seat 42 within the recess 18 in the block 12. Legs 28 are received within complementary grooves 44 in the block 12 and teeth 30 grip the material of the block 12 to preclude withdrawal of terminal member 24 once the platform 26 is seated against seat 42. Thus, assembly of terminal member 24 with block 12 is accomplished in a simple, direct fashion, and the assembly is securely held together against disassembly by the engagement of teeth 30 with the material of block 12.

In the embodiment illustrated in FIGS. 1 and 2, base 20 is parallel to the upper surface 32 of platform 26, and contact element 34, when in the downwardly extending position illustrated at 34A, extends perpendicular to base 20 and projects beyond the base 20. Upon mounting terminal block 10 on a support structure, such as a panel, as seen in phantom at 50A in FIG. 2, with base 20 upon the panel 50A, contact element 34 will pass through the support structure to provide a feed-through electrical path from the terminal portion of terminal member 24 through the panel 50A. The terminal portion further includes a clamping screw 52 received within a threaded aperture 54 in the platform 26. Clamping screw 52 is selectively movable downwardly and upwardly, toward and away from the upper surface 32 of platform 26, to selectively connect and disconnect an external conductor 56 and terminal member 24 by selectively clamping and unclamping a conductive element 58, which is secured integral with conductor 56, between the head 60 of clamping screw 52 and upper surface 32 of platform 26.

Should it be determined that access to the terminal portion of terminal member 24 is attained more readily in a particular installation by having the upper surface 32 of platform 26 extend perpendicular to the support structure upon which terminal block 10 is to be mounted, contact element 34 may be permanently deformed by bending the contact element into a second position 34B shown in phantom and in full lines in FIG. 1 and in full lines in FIG. 2. Second position 34B is at right angles to first position 34A so that contact element 34, when in the second position 34B, extends perpendicular to base 22 and projects beyond base 22. Now, terminal block 10 may be mounted upon a panel 50B, also shown in phantom in FIG. 2, with base 22 placed upon the panel 50B so that contact element 34 extends parallel to upper surface 32 of platform 26 to pass through panel 50B.

Bending of the contact element 34 from position 34A to position 34B is accomplished after terminal member 24 is assembled with and secured in block 12 by virtue of the configuration of slot 40 in the block 12. Slot 40 has a continuous opening 62 which includes a first portion 64 facing base 20 and parallel thereto and a second portion 66 facing base 22 and parallel thereto, both portions 64 and 66 being in open communication with one another to enable the contact element 34 to be moved laterally to pass from one portion of the opening 62 to the other while the terminal member 24 remains affixed to the block 12. Thus, terminal block 10 may be fabricated in a single, fully assembled configuration which is readily adapted to either one of two mounting orientations.

It is noted that portion 66 of slot 62 terminates at upper end 68 which is spaced downwardly from upper surface 32 of platform 26. In this manner, the wall portion 70 of block 12 enables the material of block 12 to serve as a complete barrier which will block conductive element 58 from entering slot 62 and possibly passing through the slot 62 to contact panel 50B, thereby precluding a short circuit between the conductor 56 and the support structure. Sufficient clearance is provided between the wall portion 70 and forward edge 36 of platform 26 to accommodate the bend at 72 in the contact element 34, when the contact element is in position 34B wherein the contact element 34 is parallel to the upper surface 32 of platform 26 and is spaced downwardly from upper surface 32 to pass beneath wall portion 70.

Figure 3:
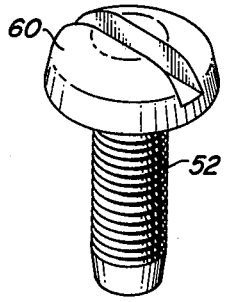
FIG. 3 is a perspective view of a clamping screw.
Figure 4:
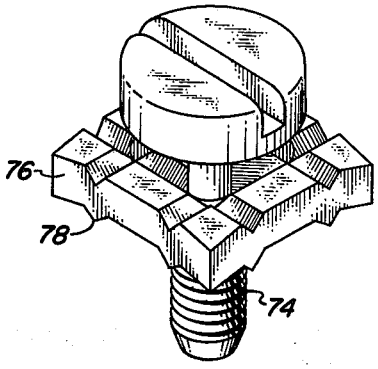
FIG. 4 is a perspective view of a clamping screw and plate assembly.

Clamping screw 52, which is also shown in FIG. 3, is employed where external conductor 56 has a conductive element 58 integral therewith. An alternate clamping means is illustrated in FIG. 4 and includes a screw 74 with a clamping plate 76 having gripping edges 78 for gripping a bare wire conductor (not shown). Thus, where bare wires are to be connected to terminal members 24, clamping screws 52 may be replaced with screws 74 and plates 76.

In the embodiment of FIGS. 1 and 2, contact element 34 is in the form of an elongate projection suitable for connection to further circuitry by machine wrapping a wire conductor of the further circuitry around the contact element 34.

Figure 5:
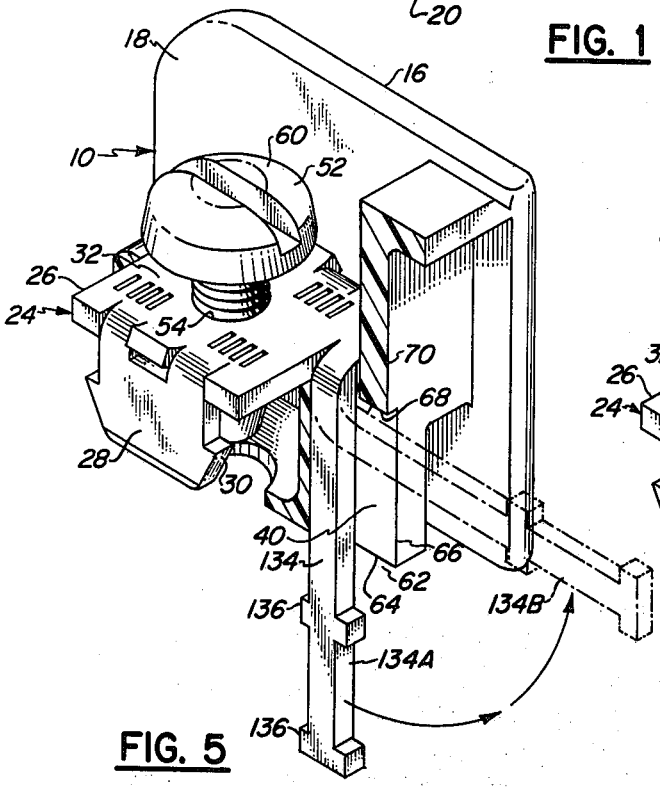
FIG. 5 is a fragmentary perspective view similar to FIG. 1, but showing another embodiment of the invention.
Figure 6:
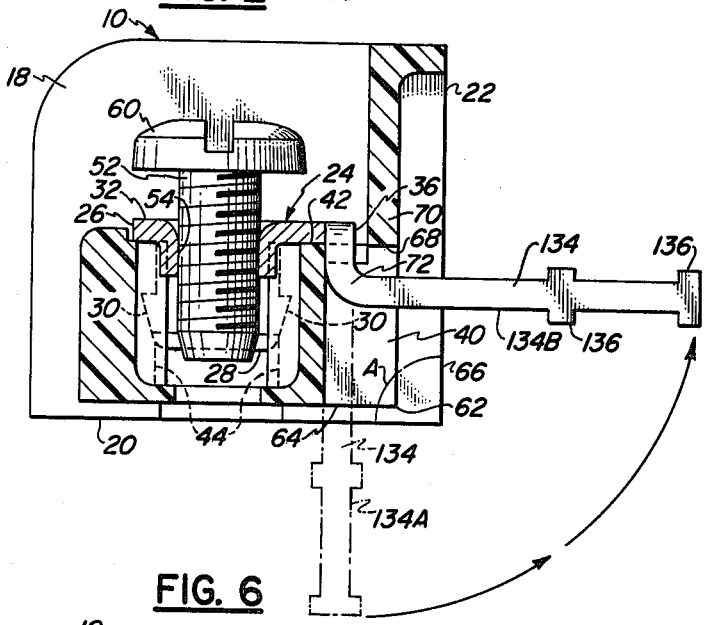
FIG. 6 is a cross-sectional view similar to FIG. 2, but showing the embodiment of FIG. 5.

In another embodiment, illustrated in FIGS. 5 and 6, an alternate contact element 134 has a configuration which includes confronting retainers 136 integral with the contact element 134 for confining a conductor which is to be hand-soldered to the contact element. Contact element 134 is permanently deformable from position 134A to position 134B.

Figure 7:
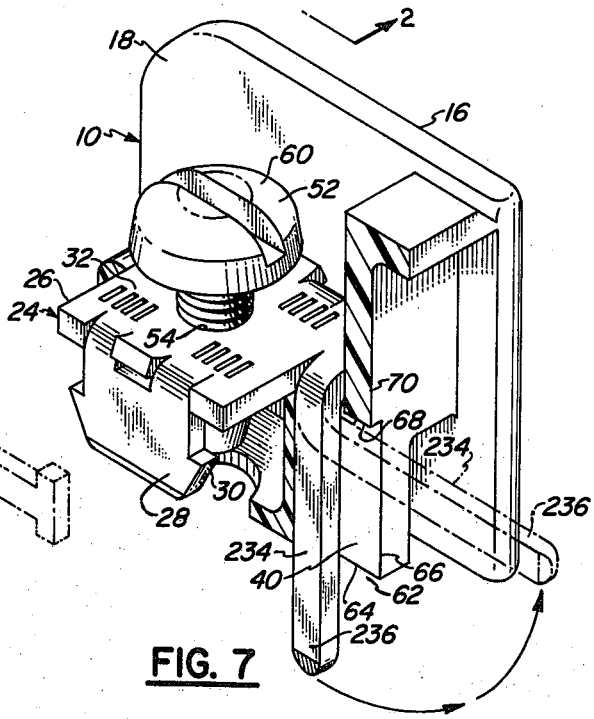
FIG. 7 is a fragmentary perspective view similar to FIG. 1, but showing a further embodiment of the invention.
Figure 8:
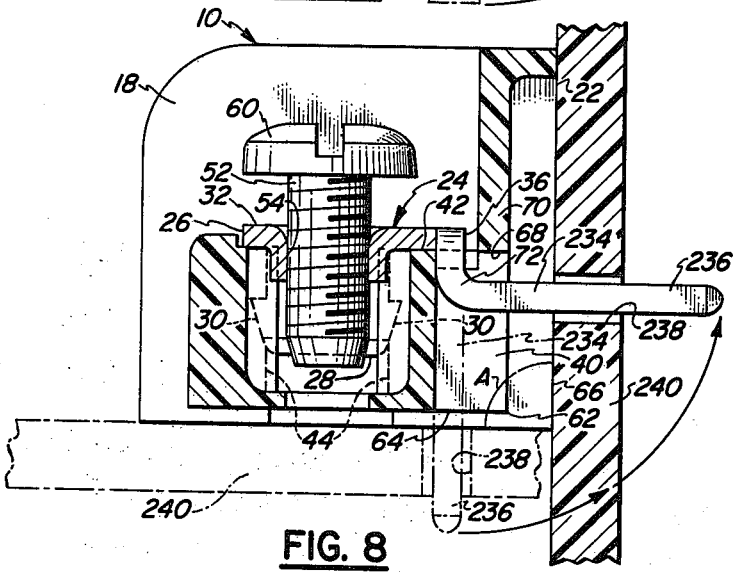
FIG. 8 is a cross-sectional view similar to FIG. 2, but showing the embodiment of FIG. 7.

A further embodiment is illustrated in FIGS. 7 and 8 wherein contact element 234 is in the form of a shorter projection or pin 236. Pin 236 may be inserted into a corresponding hole 238 in a printed circuit board 240 and may be soldered directly to the circuit on the board. Thus, the embodiment of FIGS. 7 and 8 may be mounted directly upon a printed circuit board for providing terminal members for external conductors to be connected to the circuitry on the board.

In each embodiment, the block 12 may be molded in a single, unitary construction and each terminal member 24 may be fabricated with the platform and contact element unitary with one another.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A dual orientation feed-through terminal block for detachably connecting external electrically conductive elements to further circuitry, said terminal block comprising:

a block of dielectric material having opposite sides, a first base extending between the sides, and a second base extending between the sides and making an angle with the first base;

at least one recess in the block;

a slot in the block, said slot having a continuous opening facing both of the first and second bases and communicating with the recess; and an electrical terminal member affixed to the block within the recess, the terminal member having a terminal portion for selectively connecting and disconnecting an external conductive element and the terminal member, said terminal portion including a platform having an upper surface, and said terminal member further having an integral electrical contact extending through the slot and projecting beyond one of said bases;

said contact being movable into one of first and second positions, while the terminal member remains affixed to the block, the contact in the first position thereof projecting beyond the first base and the contact in the second position thereof projecting beyond the second base, whereby the block may be mounted upon either selected one of the first and second bases and provide a feed-through beyond said selected one of the bases;

the opening of the slot including a first open portion parallel to the first base and a second open portion parallel to the second base, the first and second open portions being in open communication with one another such that the contact is movable laterally from one open portion into the other when moved from one of the first and second positions to the other; and wherein the opening of the slot is spaced from the upper surface of the platform in a direction extending downwardly from the upper surface such that the conductive element, when clamped to the upper surface of the platform, will be blocked from entering the slot by the material of the block.

2. The invention of claim 1 wherein the angle between the first and second bases is 90°.

3. The invention of claim 1 wherein:

the angle between the first and second bases is 90°;

the first and second open portions of the slot are perpendicular to one another; and the first and second positions of the contact are at right angles to one another.

4. The invention of claim 1 wherein:

the terminal portion of the terminal member includes a clamping member selectively movable toward and away from the platform to selectively clamp the external conductive element to the upper surface of the platform.

5. The invention of claim 1 wherein the contact extends generally perpendicular to the upper surface of the platform when in the first position, and extends generally parallel to the upper surface, and spaced downwardly therefrom, when in the second position.

6. The invention of claim 5 wherein the opening of the slot includes a first open portion parallel to the first base and a second open portion parallel to the second base, the first and second open portions being in open communication with one another such that the contact is movable laterally from one open portion into the other when moved from one of the first and second positions to the other.

7. The invention of claim 6 wherein:

the angle between the first and second bases is 90°;

the first and second open portions of the slot are perpendicular to one another; and the first and second positions of the contact are at right angles to one another.

8. The invention of claim 1 wherein the block of dielectric material is a unitary molded construction.

* * * * *

UNITED STATES PATENT AND TRADEMARK OFFICE

CERTIFICATE OF CORRECTION

PATENT NO. : 4,099,826

DATED : July 11, 1978

INVENTOR(S) : Charles F. Mazzeo and William T. Waddington

It is certified that error appears in the above-identified patent and that said Letters Patent are hereby corrected as shown below:

IN THE ABSTRACT

Line 6, after "into" insert --either one of two positions, while the terminal member--.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*